US012268926B2

(12) United States Patent
van Straaten

(10) Patent No.: US 12,268,926 B2
(45) Date of Patent: Apr. 8, 2025

(54) EXERCISE DEVICE

(71) Applicant: Willem Johannes van Straaten, Johannesburg (ZA)

(72) Inventor: Willem Johannes van Straaten, Johannesburg (ZA)

( * ) Notice: Subject to any disclaimer, the term of this patent is extended or adjusted under 35 U.S.C. 154(b) by 0 days.

(21) Appl. No.: 18/625,404

(22) Filed: Apr. 3, 2024

(65) Prior Publication Data

US 2024/0269507 A1 Aug. 15, 2024

Related U.S. Application Data

(63) Continuation of application No. 17/829,974, filed on Jun. 1, 2022, now Pat. No. 11,969,621, which is a continuation of application No. 17/514,582, filed on Oct. 29, 2021, now Pat. No. 11,358,024, which is a continuation-in-part of application No. 17/144,735, filed on Jan. 8, 2021, now Pat. No. 11,198,032, which is a continuation of application No. PCT/US2020/021521, filed on Mar. 6, 2020.

(30) Foreign Application Priority Data

Feb. 17, 2020 (ZA) ..... 2020/00975

(51) Int. Cl.
*A63B 21/00* (2006.01)
*A63B 22/00* (2006.01)

(52) U.S. Cl.
CPC .... *A63B 21/4039* (2015.10); *A63B 21/00058* (2013.01); *A63B 21/00185* (2013.01); *A63B 21/4047* (2015.10); *A63B 22/0087* (2013.01); *A63B 2208/0252* (2013.01); *A63B 2208/0261* (2013.01); *A63B 2225/62* (2013.01)

(58) Field of Classification Search
CPC ..... A63B 21/4039; A63B 2208/0261; A63B 21/00058; A63B 21/00185; A63B 21/4035; A63B 21/4047; A63B 2208/0252; A63B 2225/62
See application file for complete search history.

(56) References Cited

U.S. PATENT DOCUMENTS 4,109,960 A * 8/1978 Stinchfield ..... A47C 3/16 297/452.17
4,902,003 A * 2/1990 Buoni ..... A63B 23/0211 297/258.1
5,033,742 A * 7/1991 Johnson ..... A63B 21/4037 441/130
5,364,161 A * 11/1994 Liu ..... A63G 13/06 D6/345
D360,665 S * 7/1995 Hatfield ..... D21/688
(Continued)

FOREIGN PATENT DOCUMENTS

CN 303993192 S 1/2017
TW M461447 U 9/2013

OTHER PUBLICATIONS

International Search Report and Written Opinion issued on Jul. 15, 2020 in International Patent Application PCT/US2020/021521.
(Continued)

*Primary Examiner* — Joshua Lee
(74) *Attorney, Agent, or Firm* — Kenneth E. Horton; Barnes & Thornburg LLP

(57) ABSTRACT

An exercise device having rounded ends of differing radii.

20 Claims, 7 Drawing Sheets

(56) References Cited

U.S. PATENT DOCUMENTS

| | | | | |
|---|---|---|---|---|
| 5,605,526 | A * | 2/1997 | Hatfield | A47C 9/002 482/142 |
| 5,795,276 | A * | 8/1998 | Almeda | A63B 23/0211 606/240 |
| 7,033,307 | B2 | 4/2006 | Van Straaten | |
| D523,494 | S | 6/2006 | Van Straaten | |
| D523,913 | S | 6/2006 | Van Straaten | |
| D524,385 | S * | 7/2006 | Webb | D21/687 |
| D526,033 | S | 8/2006 | Van Straaten et al. | |
| D526,369 | S | 8/2006 | Van Straaten | |
| 7,134,988 | B2 | 11/2006 | Van Straaten et al. | |
| D571,871 | S * | 6/2008 | Backstrand | D21/686 |
| 2004/0033873 | A1* | 2/2004 | Van Straaten | A63B 23/0216 482/142 |
| 2005/0187085 | A1* | 8/2005 | Webb | A63B 21/4037 482/142 |
| 2006/0014613 | A1* | 1/2006 | Van Straaten | A63B 23/0211 482/140 |
| 2009/0143205 | A1* | 6/2009 | Jahns | A63B 23/0211 482/148 |
| 2011/0028289 | A1* | 2/2011 | Jahns | A63B 23/0211 482/142 |
| 2013/0253582 | A1* | 9/2013 | Tielve | A61H 1/0292 606/240 |

OTHER PUBLICATIONS

Office Action of the ROC (Taiwan) Intellectual Property Office issued on Jan. 18, 2021 in Taiwan Design Patent Application 109302248.

Office Action issued by the Intellectual Property Office in ROC (Taiwan) Patent Application No. 110100930 on Dec. 27, 2021.

* cited by examiner

EXERCISE DEVICE

CROSS REFERENCE TO RELATED APPLICATION

This application is a continuation of U.S. patent application Ser. No. 17/829,974 filed Jun. 1, 2022, which is a continuation of U.S. patent application Ser. No. 17/514,582, filed Oct. 29, 2021, entitled Exercise Device, which is a continuation-in-part of U.S. application Ser. No. 17/144,735, filed Jan. 8, 2021, entitled Exercise Device, which is a continuation of International Application PCT/US2020/021521, filed Mar. 6, 2020, entitled Exercise Device, which claims priority to South African provisional application number 2020/00975, filed Feb. 17, 2020, entitled Exercise Device, all of which are incorporated herein by reference.

FIELD

The present disclosure relates to exercise devices. In particular, exercise devices that may be used in a plurality of positions to condition various parts of the body.

BACKGROUND OF THE INVENTION

The disclosed exercise device supports and orientates the body in diverse ways to enable effective exercising. In addition, the exercise device provides resistance and a method to vary the resistance to exercise different muscles of different strengths, to vary the resistance whilst exercising specific groups of muscles, to match the level of resistance to the change in muscle strength as the muscle tires while exercising, and to increase resistance as the strength of a muscle increases over time.

Existing exercise devices often position a user very close to the ground or on the ground, making it uncomfortable for the user to exercise and making it difficult for an unconditioned person to use the exercise device or aid.

Traditional exercise devices may also pose a risk to the user by allowing the exercise device to tip too far backwards during use.

Conventional exercise devices often provide insufficient resistance and no ability to vary the resistance as a user improves their strength.

SUMMARY OF THE INVENTION

The disclosed exercise device may allow an exerciser to position themselves more comfortably and safer than on existing exercising aids. The unique asymmetrical shape may enhance exercise results by improving safety. The shape may provide a more stable structure that inhibits or eliminates tipping past a point in which a user is in control of the device position. Furthermore, resulting from the asymmetrical shape of the device, an increase in exercise resistance can be achieved compared to other soft material exercise devices.

The invention provides an exercise device comprising an inflatable, or semi-solid, or solid body with a structure having a surface with multiple curved portions that allow the device to move in a controlled manner when a user in engaged with the device, and provide various amounts of resistance a user may apply to obtain the level of workout intensity desired.

BRIEF DESCRIPTION OF THE DRAWINGS

The invention is further described by way of examples with reference to the following accompanying drawings.

DESCRIPTION OF EMBODIMENTS

Figure 1A:
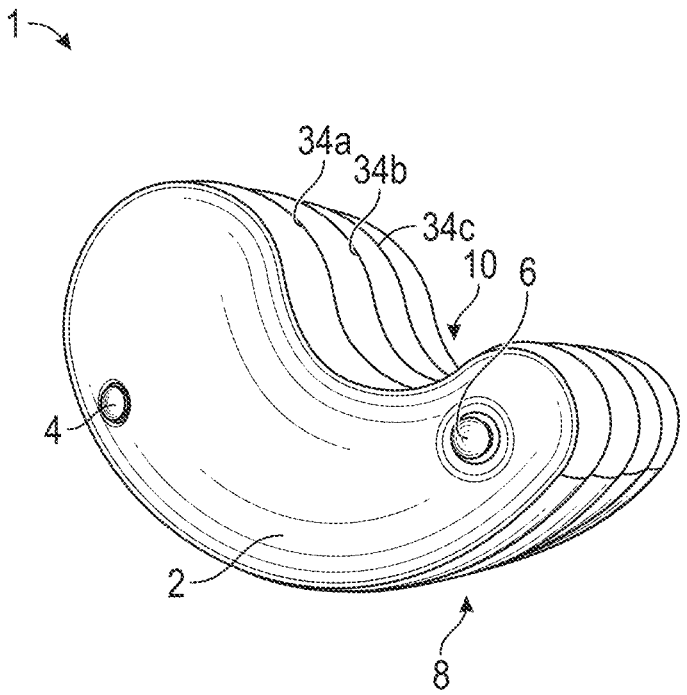
FIGS. 1A and 1B are isometric views of an exercise device in two orientations, with a concave side at the top and with a convex side at the top, respectively.
Figure 1B:
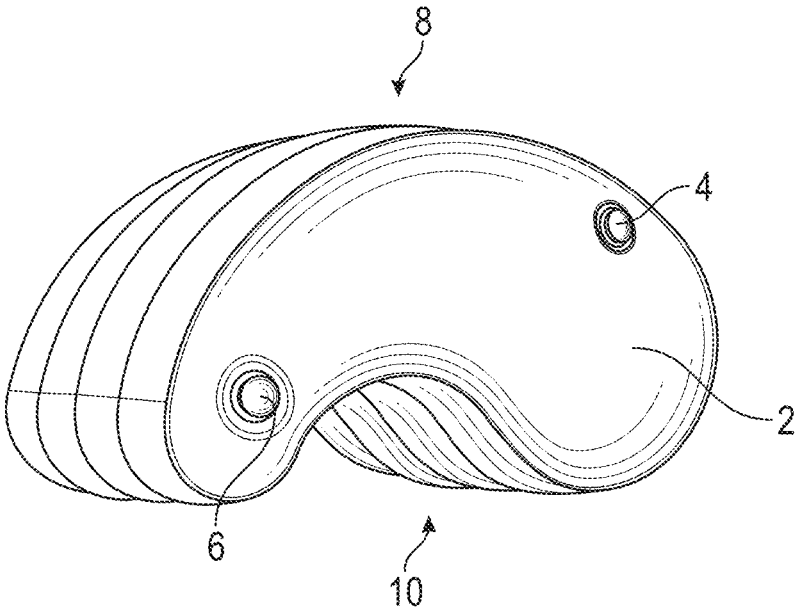
Figure 2:
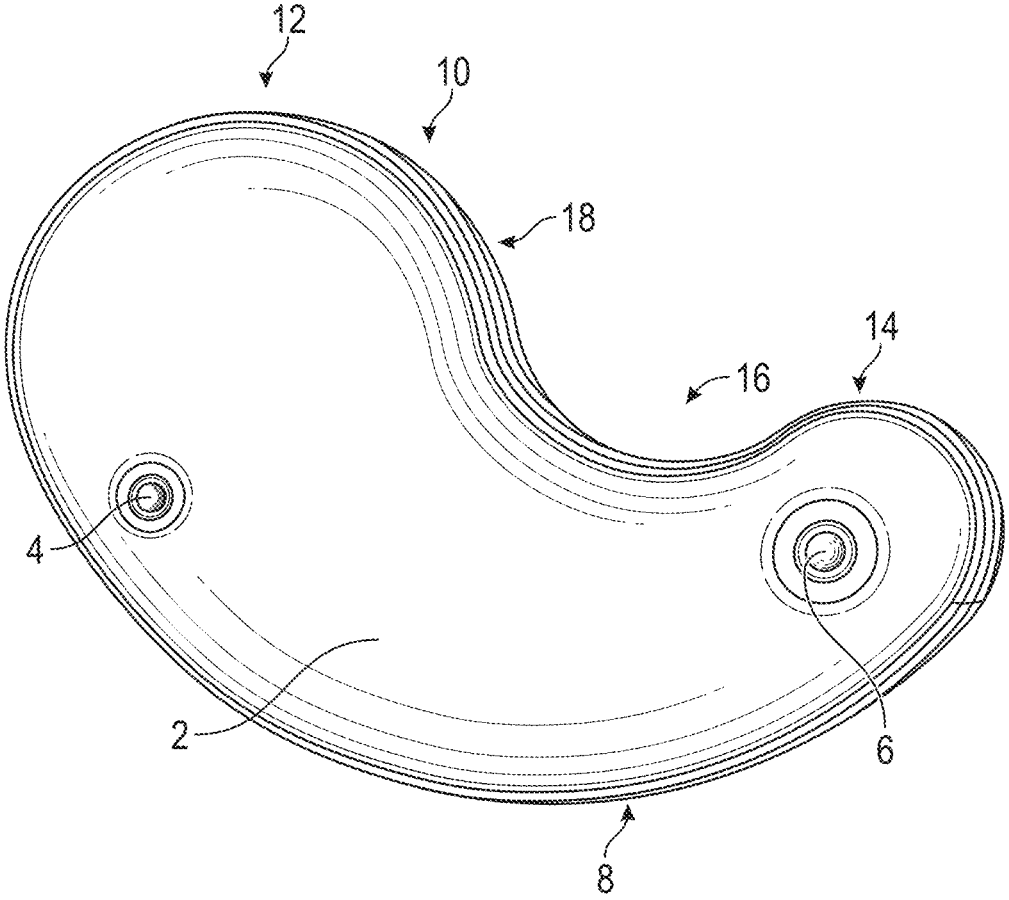
FIG. 2 is a side view of the exercise device of FIG. 1A.

FIGS. 1A and 1B are isometric views of an exercise device in two orientations. FIG. 1A shows exercise device 1 resting on the convex surface of its first side 8. FIG. 1B shows exercise device 1 resting on its opposing, second side 10. As can be seen in FIGS. 1A, 1B and 2, exercise device 1 includes a first side 8 with a surface, at least part of, which is curved outwardly in a generally convex form, and an opposing second side 10 with modified s-shaped surface. The s-shaped surface includes a first area defining a concave seat-accommodating recess 16 to accommodate a user's buttocks, and a second area defining a convex back-supporting portion 18 to accommodate a user's back.

FIG. 2 shows the surfaces of first side 8 and second side 10 are connected via a first rounded end 12 with a relatively large radius and a second rounded end 14 with a relatively small radius, wherein first and second rounded ends 12, 14 are disposed at opposite ends of first side 8 and second side 10, thereby defining an asymmetrically shaped structure. The asymmetrical shape has a first rounded end 12 significantly bigger than second rounded end 14, which may result, depending on the material of the device, in the fill inside the body of the exercise device being unevenly distributed, with first rounded end 12 housing the bulk of the volume of the fill and second rounded end 14 of the exercise device, housing a lesser volume of the fill.

In one illustrative embodiment, exercise device 1 may comprise an inflatable body with air as the fill inside the body. The volume of air may be unevenly distributed, with first rounded end 12 containing a volume of air that is significantly more than what is contained in second rounded end 14.

First side 8 of exercise device 1 may be curved outwardly in a first direction extending between first rounded end 12 and second rounded end 14.

To exercise, an exerciser may use exercise device 1 in at least two ways: First, by positioning exercise device 1 with its first side 8 on the floor as shown in FIG. 1A, the exerciser may sit in concave area 16 with feet on the ground and the exerciser's back supported, at least partially, by the adjacent, outwardly curved convex support 18 on second side 10. Moving or readjusting one or more parts of the body on the surface of second side 10 or pushing or pulling with the feet against the ground may cause a change in the exerciser's weight distribution or center of gravity and thereby cause a rotating or tipping movement of exercise device 1 with a different portion of the convex ground-engaging surface of the first side contacting the ground.

Figure 3A:
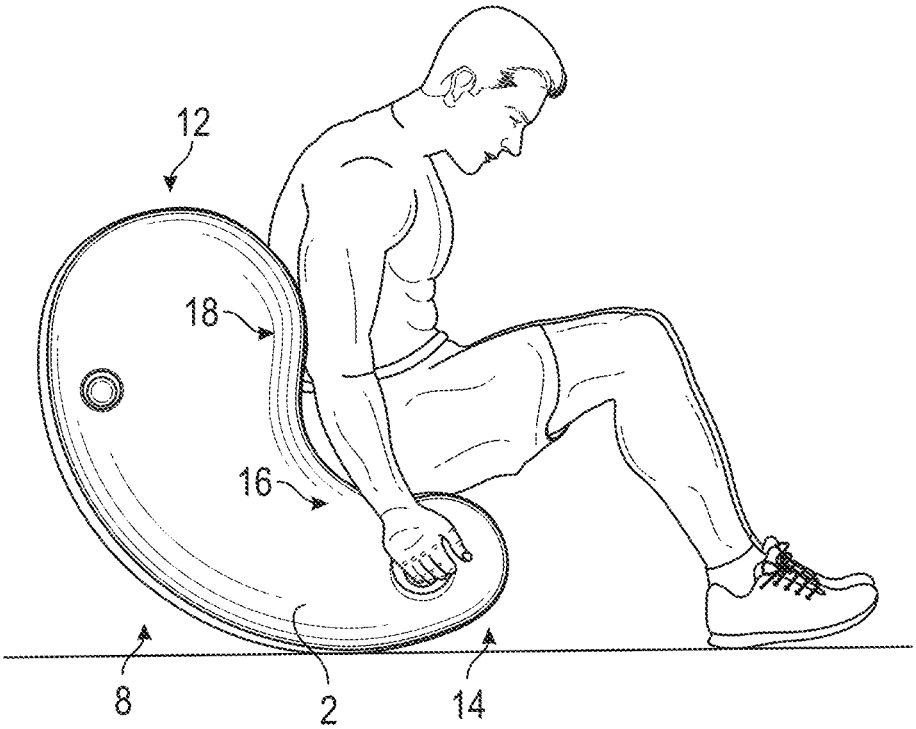
FIGS. 3A and 3B are side views of the exercise device as per FIG. 2 with an exerciser exercising in two positions.
Figure 3B:
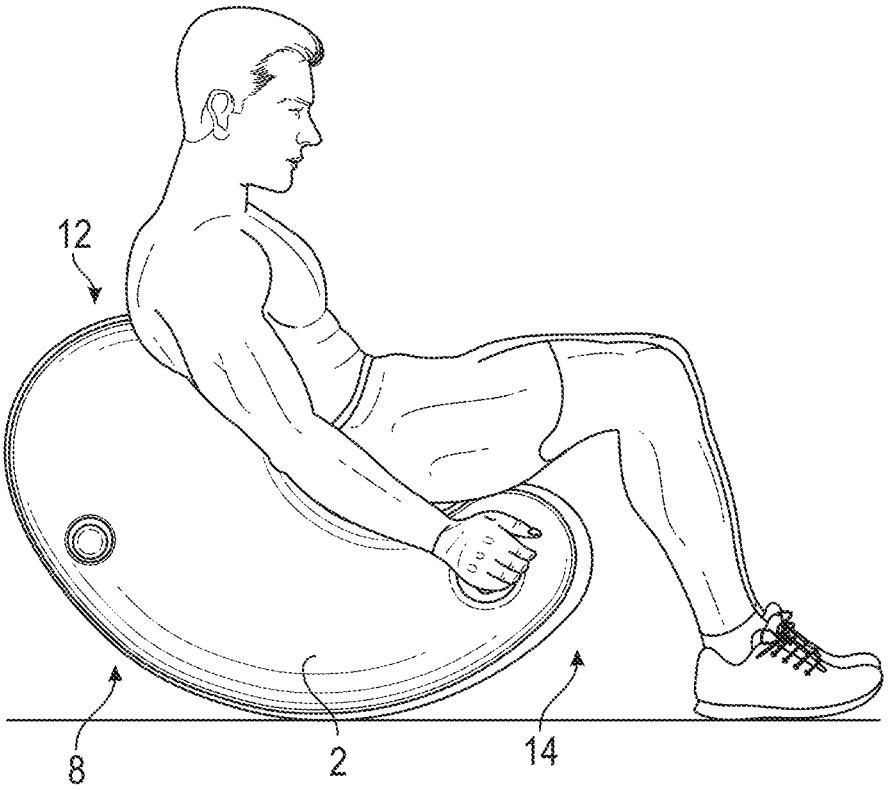

FIGS. 3A and 3B are side views of exercise device 1 as per FIG. 2 with an exerciser exercising in two positions a and b. By sitting in concave area 16 of second side 10 adjacent to second rounded end 14, and with the back against convex support 18 adjacent to first rounded end 12, an exerciser, when pushing with the feet against the ground, generates a force that is applied against convex support 18 adjacent to first rounded end 12. Resulting from the asymmetrical shape of exercise device 1, when applying force with the back against convex support 18 adjacent to the relatively big first rounded end 12, while sitting in concave area 16 adjacent to the relatively small second rounded end 14, exercise device 1 generates a counter force for exercising that becomes progressively higher the further second rounded end 14 is rotated and tipped backwards towards the floor.

Also, when exercising sitting in concave area 16 adjacent to the relatively smaller second rounded end 14 with the back pressed against convex support 18 adjacent to the relatively large first rounded end 12, the asymmetrical shape in general and in particular the relatively larger first rounded end 12 of exercise device 1 prevents or inhibits it from being tipped too far backwards by providing a counterforce that resists the force applied by the exerciser, which may reduce the risk of potential injury to the exerciser.

By moving the body's center of gravity and/or by pulling with the feet against the ground, generates a force that is applied against the second rounded end 14. Resulting from the asymmetrical shape of exercise device 1, when applying force while sitting in concave area 16 adjacent to the relatively small second rounded end 14, exercise device 1 generates a force for exercising that becomes progressively lighter the further the second rounded end 14 is rotated and tipped forwards towards the floor.

Figure 4:
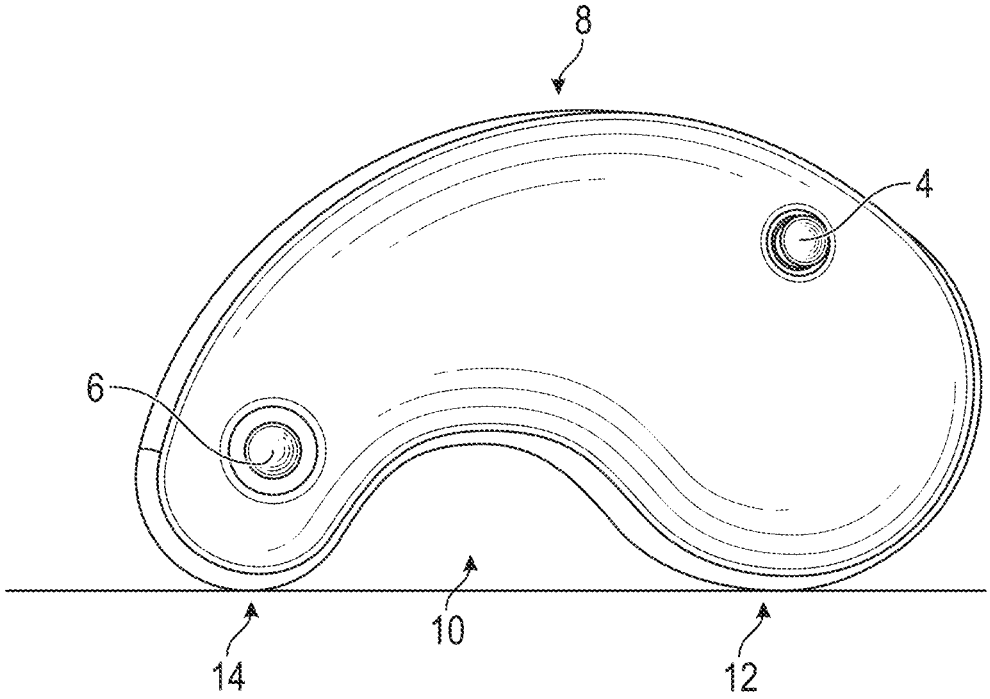
FIG. 4 is a side view of the exercise device of FIG. 1B.
Figure 5:
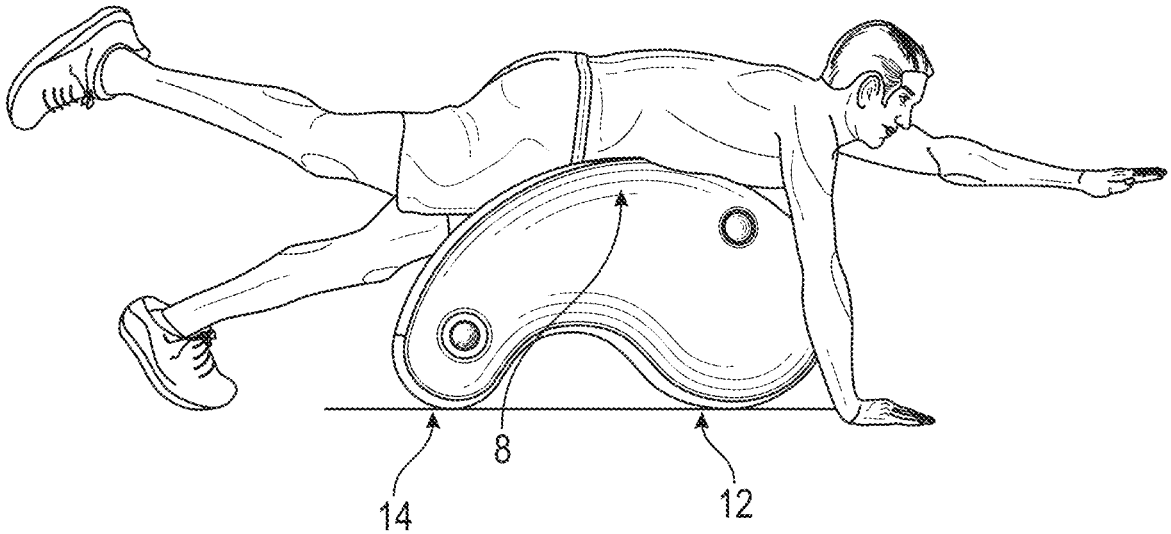
FIG. 5 is a side view of the exercise device of FIG. 4 with an exerciser exercising face down.
Figure 6:
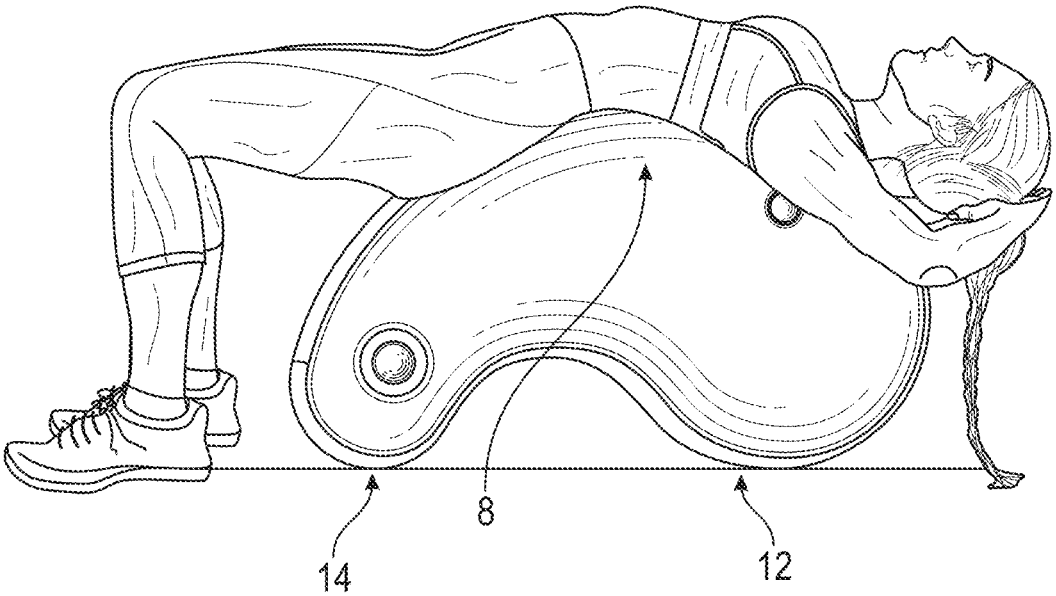
FIG. 6 is a side view of the exercise device of FIG. 4 with an exerciser exercising face up.

As shown in FIGS. 4-6, the exerciser may further use exercise device 1 by positioning it with its second side 10 on the ground. In this orientation, the outwardly curved first side 8 is facing upwards, with first rounded end 12 higher above the ground than second rounded end 14 that is positioned nearer the ground. An exerciser may perform exercise movements by positioning the body onto the surface of the first side 8 facing downwards, as shown in FIG. 5, or as shown in FIG. 6, upwards, with the head towards first rounded end 12, or second rounded end 14, or facing sideways, and with the body bent forwards or backwards.

Generally, specific distances, distance ranges and relative distances described as measured from the ground are taken with exercise device 1 at rest on its convex surface 8.

The structure of the exercise device may include optional handles 6, which can be gripped by an exerciser during use of exercise device 1. In the illustrative embodiment shown in the drawings, handles 6 are located toward second rounded end 14. In a further embodiment, handles 6 are more centrally located, such as beneath concave area 16, as viewed in FIG. 1A, preferably positioned so users of various sizes may easily reach them. Handles 6 may be ergonomically shaped to assist a user in various exercises using exercise device 1, which may take into account the different positions exercise device 1 may have with respect to a user, such as those shown in FIGS. 3A, 3B, 5 and 6.

The exercise device may include an air valve 4 to enable pumping or blowing air into inflatable body 2. Valve 4 may be recessed to reduce unwanted contact by an exerciser with the valve.

Further details of the structure and use of exercise device 1 will now be provided.

Turning to FIGS. 1A and 1B, embodiments of exercise device 1 are shown that are made from flexible material, such as plastic sheet material, to form an inflatable body 2 with a structure that is asymmetrical in shape to aid in performing exercises. In a further embodiment, exercise device 1 may be made from a solid piece of foam, or other materials that provides the support needed to utilize the device in the manner that is described herein. Although exercise device 1 may be constructed of various materials, for simplicity the exercise device will be described herein at times as it relates to an inflatable construction. Inflatable body 2 is inflated via an air valve 4, typically using a foot pump (not shown) or electric pump (not shown). To facilitate exercise, a pair of handles 6 is attached to inflatable body 2. In one orientation (seen in FIG. 1A), exercise device 1 can be positioned with first side 8 facing down and second side 10 facing up. In another orientation (seen in FIG. 1B), exercise device 1 is positioned with first side 8 facing up and second side 10 facing down.

FIG. 2 is a side view of exercise device 1 with first side 8 facing down and second side 10 facing up. Inflatable body 2 has a first, outwardly curved, convex, shaped side 8 connected and linked to a second side 10 via first rounded end 12, on one side of inflatable body 2, and second rounded end 14, disposed on the other end of inflatable body 2, with first rounded end 12 having a radius that is significantly larger than the radius of second rounded end 14. Second side 10 is shaped with a concave area 16 that is recessed to form a seat for an exerciser and positioned adjacent to second rounded end 14. Convex support 18 is positioned between concave area 16 and first rounded end 12, or as a part of first rounded end 12, which is curved outwardly, and which forms a convex back support 18 for the back of an exerciser.

FIGS. 3A and 3B are side views of exercise device 1 of FIG. 2 and show first side 8 facing down. An exerciser is shown performing exercise movements in two positions: a and b. In position a, the exerciser is sitting on concave area 16, leaning forward, with the back against convex support 18. In this position, first rounded end 12 is relatively high above the ground compared to second rounded end 14, which is relatively close to the ground.

In position b, the exerciser is pushing against convex support 18, causing inflatable body 2 to roll and rotate counterclockwise along the outwardly curved first side 8, causing first rounded end 12 to move closer to the ground and second rounded end 14 to move further away from the ground. Resulting from the asymmetrical shape of inflatable body 2, as the exerciser continues to push against convex support 18 and the inflatable body rolls and rotates counterclockwise, the resistance of pushing against convex support 18 progressively increases, making the exercise more difficult to perform. Also, resulting from first rounded end 12 forming part of convex support 18 and by sitting on second rounded end 14 on the opposite side of inflatable body 2, when rotating the asymmetrical structure counterclockwise, inflatable body 2 is restrained from rolling and rotating too far backwards, hindering tipping too far backwards, which could potentially cause injury to the exerciser.

Turning back to FIG. 3A, in position a, once the center of gravity of the exerciser's body is moved forward towards the right and/or by pulling with the feet against the ground, a force is generated that is applied in the direction of second rounded end 14. Resulting from the asymmetrical shape of exercise device 1, when applying force while sitting in concave area 16 adjacent to the relatively small second rounded end 14, exercise device 1 generates a force for exercising that becomes progressively lighter the further second rounded end 14 is rotated and tipped forwards towards the floor.

FIG. 4 is a side view of exercise device of FIG. 1 with first side 8 facing up. First rounded end 12 and second rounded end 14 are in contact with the floor, which stabilizes inflatable body 2 when used in this orientation to exercise. Also, as a result of the relatively large size of first rounded end 12 relative to the small size of second rounded end 14, the exercise surface of first side 8 becomes "angled" with first rounded end 12 further away from the ground than second rounded end 14. This asymmetrical nature of the exercise surface aids in the variety of exercises and the effectiveness of exercises that can be performed.

FIG. 5 is a side view of exercise device 1 in the position described with respect to FIG. 4 above, showing an exerciser exercising face down. Resulting from the large size of first rounded end 12 relative to the smaller size of second rounded end 14, the exercise surface of first side 8 becomes "angled" with first rounded end 12 farther away from the ground than second rounded end 14, thereby allowing the upper body of the exerciser to be farther away from the ground than the lower body while exercising.

FIG. 6 shows the same view of exercise device 1 as is shown in FIG. 5 above, but with an exerciser exercising face up. Again, resulting from the large size of first rounded end 12 relative to the smaller size of second rounded end 14, the exercise surface of first side 8 supports the exerciser's upper body further from the ground than the lower body while exercising, a position that may favor the performance of certain exercises.

Figure 7:
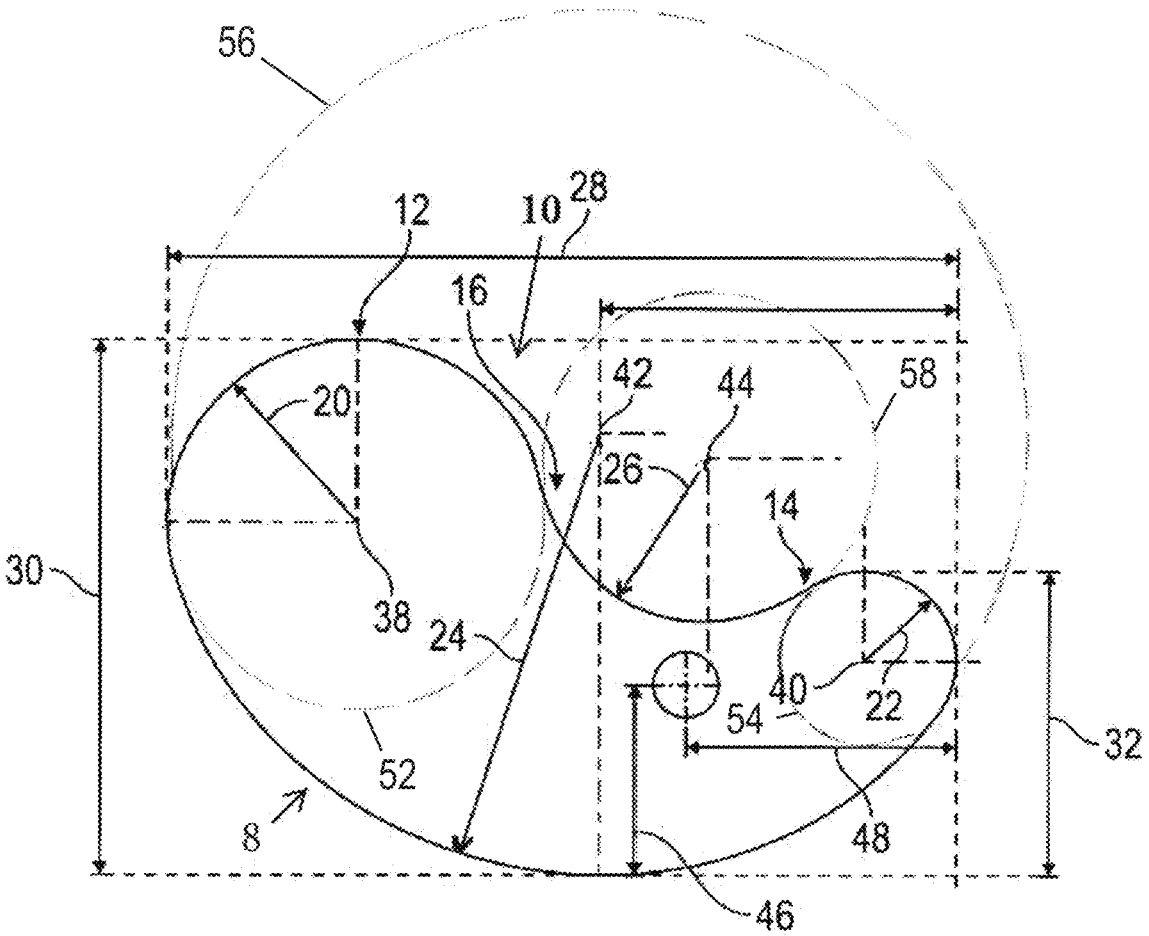
FIG. 7 depicts illustrative dimensions of an exercise device.

FIG. 7 depicts a longitudinal elevation side view of exercise device 1 with illustrative dimensions. The radius 20 of first round end 12 is larger than the radius 22 of second round end 14. In an illustrative example, radius 20 of first round end 12 is in the range of 200-240 mm, with a further illustrative range of 210-230 mm. In an illustrative example, radius 22 of second round end 14 is in the range of 100-120 mm, with a further illustrative range of 105-115 mm. The relationship between the radius 20 of first rounded end 12 and radius 22 of second rounded end 14 may be described for example, as radius 20 of first rounded end 12 being in the range of 1.9-2.2 times larger than radius 22 of second rounded end 14, or further radius 20 may be 1.8-2.1 times larger than radius 22.

The radius 26 of concave area 16 may be in the range of 185-205 mm. A further illustrative range of radius 26 is 190-200 mm. In illustrative embodiments the relationship between the radius 22 of second rounded end 14 and radius 26 of concave area 16 of second side 10, may be described for example, as radius 26 of concave area 16 of second side 10 being in the range of 1.6-1.9 times larger than radius 22 of second rounded end 14, or further radius 26 may be 1.7-1.8 times larger than radius 22. The relative radius 26 may advantageously provide improved back support for common exercises such as crunches.

The relative radii of radius 20 of first rounded end 12 to radius 26 of concave area 16 of second side 10, may also promote device stability, comfort and user support. In an illustrative embodiment radius 20 of first rounded end 12 is 11% to 14% larger than radius 26 of concave area 16.

As noted above, the asymmetrical shape of exercise device 1 may provide stability and facilitate different exercises. The difference in height of first rounded end 12 and second rounded end 14 from the ground may provide these advantages. In an illustrative embodiment, height 30 as measured from the top of first rounded end 12 to the ground is in the range of about 620-660 mm. A further illustrative range of height 30 is 610-650 mm.

In an illustrative embodiment, height 32 as measured from the top of second rounded end 14 to the ground is in the range of about 340-380 mm. A further illustrative range of height 32 is 350-370 mm. In an illustrative embodiment height 30 is 70%-80% greater than height 32. In a further illustrative embodiment height 32 is 70%-80% of height 30.

In an illustrative embodiment, height 30 is in the range of 555 mm to 595 mm, and height 32 is in the range of 415 mm to 455 mm.

Illustrative ranges of the radius 24 of first side 8 include, 500-540 mm and 510-530 mm. The radius 26 relative to radius 24 may advantageously provide improved rotation of first side 8 when an exerciser performs exercises whilst positioned on second side 10 of exercise device 1.

Illustrative positions of the center points of arcs that define first round end and second round end are as follows. Center point 38 of first rounded end may be positioned in the range of 400-440 mm from the bottom of exercise device 1. Center point 40 of second rounded end 14 may be positioned in the range of 230-270 mm from the bottom of exercise device 1.

In a further illustrative embodiment center point 38 of first rounded end may be positioned in the range of 300-400 mm from the bottom of exercise device 1. Center point 40 of second rounded end 14 may be positioned in the range of −270-370 mm from the bottom of exercise device 1.

First rounded end 12 may be defined by a first arc having a first center point. Second rounded end 14 may be defined by a second arc having a second center point. Radius 20 of first rounded end 12 is then defined by a distance between the first center point and a point on the first arc, and radius 22 of second rounded end 14 is defined by a distance between the second center point and a point of the second arc.

An illustrative position of center point 42 of arc of first side 8 is in the range of 500-540 mm from the bottom of exercise device 1.

An illustrative position of center point 44 of concave area 16 is in the range of 475-515 mm from the bottom of exercise device 1.

An illustrative position of handle 6 is schematically shown in FIG. 7. Although shown as a circle, handle 6 may have other shapes so the center point 46 of handle 6 does not necessarily reflect the center of a circle. The center point 50 of handle 6 may be positioned for example, in the range of 210-240 mm above the bottom of exercise device 1, as identified by dimension 46, and in the range of 305-325 from the front end of exercise device 1, as identified by dimension 48. It is noted that handle 6 may be positioned elsewhere on exercise device, for example as shown in FIGS. 1A, 1B.

Width 28 extends between a point at which a circle defined by radius 20 of first round end 12 meets a circle defined by radius 24 of first side 8, and a point at which a circle defined by radius 22 of second round end 14 meets the circle defined by radius 24 of first side 8. As shown in FIG. 7 the circle defined by radius 20 of first round end 12 and the circle defined by radius 22 of second round end 14 may each intersect the circle defined by radius 24 of the convex surface of first side 8 at their outer most points. As further shown in FIG. 7, width 28 is equal to radius 20 plus radius 22 plus the distance between the center points of the circles formed by each of radii 20, 22. As one skilled in the art can calculate based on the specification ranges disclosed herein, width 28 may be for example, in the range of 600 mm-1,080 mm.

In an illustrative embodiment, a first circle 52 defined by radius 20 of first rounded end 12 and a second circle 54 defined by radius 22 of second rounded end 14, are both within a third circle 56 defined by radius 24 of first side 8. A fourth circle 58 defined by radius 26 of the concave area 16 of second side 10 meets each of first circle 52 and second circle 54. As shown, circles 52, 54, 56, 58 abut one another, but as will be understood by the ranges and sizes of various dimensions, the illustrative circles can be laid out with some overlap. Thus, the relative positions of circles 52, 54, 56, 58 depicted having radii 20, 22, 24, 26, respectively may be varied from what is shown in FIG. 7. For example, the circles are shown as not overlapping one another, however, in illustrative embodiments these circles can overlap in one or more places.

In an illustrative embodiment, the center of circle 56 formed by radius 24 of the convex surface of first side 8 is higher than the center of circle 58 formed by radius 26 of the concave portion of second side 10, which is higher than the center of circle 52 formed by radius 20 of first rounded end 12, which is higher than the center of circle 54 formed by radius 22 of second rounded end 14. This configuration can facilitate a user performing exercises while having their feet on the ground, while allowing for the user to more easily return to a standing position. Furthermore, having the surface of side 8 being a continuous arc extending from circles 52, 54 formed by radii 20 and 22 further assists in balancing exercise device 1 and providing the ability to rock to a sufficient degree to perform various conditioning exercises.

Figure 8:
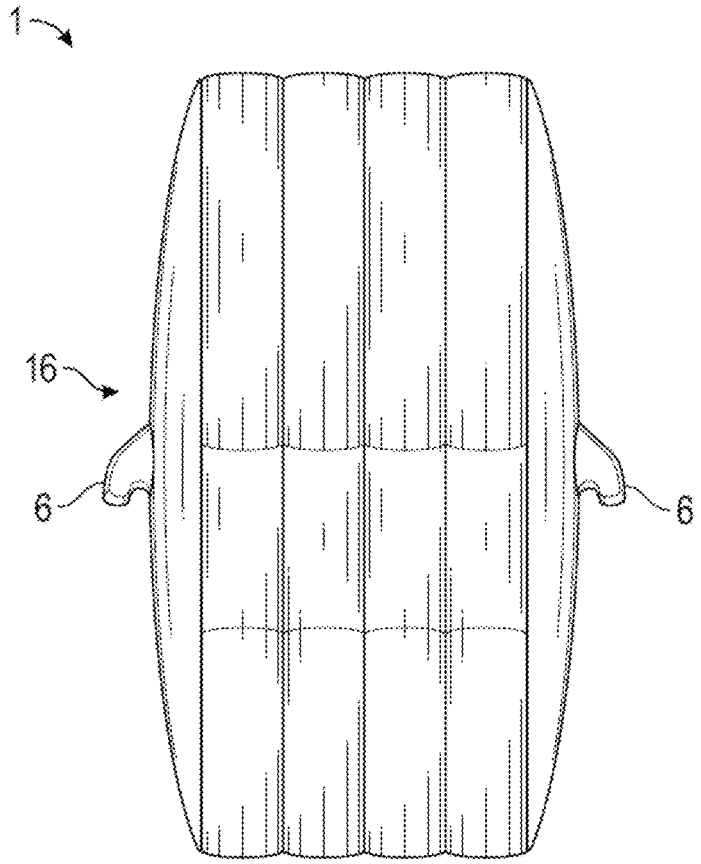
FIG. 8 depicts an exercise device with illustrative handles positioned centrally below a concave area on a side of the exercise device.

FIG. 8 depicts an exercise device 1 with illustrative handles 6 positioned centrally below concave area 16 of second side 10. In the particular embodiment shown, handles 6 are ergonomically configured, but could also have other configurations. There also may be more than one handle positioned on a side of exercise device 1 to aide in performing difference exercises.

Turning back to FIGS. 1A and 1B, longitudinal lines 34*a-c* may be seen on the surface of exercise device 1. These lines result from partitioning panels within inflatable body 2. The partitioning panels have openings through which air may flow to facilitate inflating the device. The holes though may be small enough so a rupture in one compartment will not create a sudden deflation of the entire device. The panels also provide structural integrity to exercise device 1. The invention is not limited to three longitudinal lines 34*a-c* forming four sections. In a further illustrative embodiment there may be one to five sections. The sections between longitudinal lines 34*a-c* may be of even width or may vary. In an illustrative embodiment there are three sections with the central section wider than either of the other two sections, and the other two sections being of even width with one another. The distribution and size of panels can create different firmness, which can facilitate use during certain exercises.

U.S. Pat. Nos. 7,033,307B2 and 7,134,988B2 describe exercising aids that have shortcomings that may be overcome by embodiments of the exercise device disclosed herein. Some of the shortcomings of prior art exercising aids include: difficulty for an unconditioned user to perform exercises using the device and to stand up from a seated position on the aid; risk of injury from the exercising aid tipping backward; and resistance being lower than may be needed to achieve the desired workout level.

The invention includes methods of exercising, conditioning and physical therapy having the steps of: providing an exercise device according to any of the embodiments described herein and their equivalents, and performing physical therapy, strengthening, balancing or conditioning exercises using the device to facilitate the exercises, including varying resistance while performing the exercises. In a particular embodiment, exercise device 1 is inflated or deflated to a firmness conducive to a selected exercise.

While the invention has been described by illustrative embodiments, additional advantages and modifications will occur to those skilled in the art. Therefore, the invention in its broader aspects is not limited to specific details shown and described herein. Modifications, for example, to specific shapes and sizes and incorporation of equivalent components, may be made without departing from the spirit and scope of the invention. Accordingly, it is intended that the disclosed exercise device not be limited to the specific illustrative embodiments, but be interpreted within the full spirit and scope of the appended claims and their equivalents.

The invention claimed is:

1. An exercise device comprising:

a body having:

a first side having a convex surface having a radius;

a second side opposing the first side, the second side having a concave area with a radius;

the convex surface of the first side connected at one end to the concave area of the second side by a first rounded end having a radius and connected at an opposing end by a second rounded end having a radius, wherein the radius of the first rounded end is larger than the radius of the second rounded end; and wherein the radius of the first rounded end is in the range of 200-240 mm.

2. The exercise device of claim 1 wherein the radius of the convex surface of the first side is in the range of 500-540 mm.

3. The exercise device of claim 1 wherein:

a width of the exercise device is less than the radius of the first side, wherein the width extends between a point at which a circle defined by the radius of the first rounded end meets a circle defined by the radius of the first side, and a point at which a circle defined by the radius of the second rounded end meets the circle defined by the radius of the first side; and the circle defined by the radius of the first rounded end and the circle defined by the radius of the second rounded end each intersect the circle defined by the radius of the first side at their outer most points.

4. The exercise device of claim 3 wherein the width is in the range of 600-1080 mm.

5. The exercise device of claim 4 wherein:

the circle defined by the radius of the first rounded end and the circle defined by the radius of the second rounded end do not overlap; and a circle defined by the radius of the concave area of the second side meets each of the circles defined by the radius of the first rounded end and the radius of the second rounded end.

6. The exercise device of claim 1 wherein the radius of the concave area of the second side is in the range of 185-205 mm.

7. The exercise device of claim 1 wherein the radius of the concave area of the second side in the range of 1.6-1.9 times larger than the radius of the second rounded end.

8. The exercise device of claim 1 wherein the radius of the first rounded end is in the range of 1.9-2.2 times larger than the radius of the second rounded end.

9. The exercise device of claim 1 comprising plastic sheet material forming an inflatable body.

10. The exercise device of claim 9 wherein the inflatable body is configured for the first rounded end to contain a volume of air greater than the second rounded end.

11. The exercise device of claim 1 wherein the relative difference in the first rounded end radius and the second rounded end radius creates a counterforce to force applied by the user, thereby inhibiting tipping backward when a user is exercising while seated on the concave area of the second side.

12. The exercise device of claim 1 wherein:

the center of a circle formed by the radius of the convex surface of the first side is higher than the center of a circle formed by the radius of the concave area of the second side, which is higher than the center of a circle formed by the radius of the first rounded end, which is higher than the center of a circle formed by the radius of the second rounded end.

13. The exercise device of claim 1 wherein the radius of the first rounded end is 11% to 14% larger than the radius of the concave area of the second side.

14. The exercise device of claim 1 comprising a solid piece of foam.

15. The exercise device of claim 1 wherein the exercise device has a bottom and the concave area has a center point positioned in the range of 475-515 mm from the bottom of the exercise device.

16. The exercise device of claim 1 wherein a width extending between a point at which a first rounded end circle defined by the radius of the first rounded end meets a first side circle defined by the radius of the first side, and a point at which a second rounded end circle defined by the radius of the second rounded end meets the first side circle, wherein the first rounded end circle and the second rounded end circle are within the first side circle.

17. The exercise device of claim 16 wherein the width is in the range of 600-1080 mm.

18. The exercise device of claim 1 wherein the first rounded end is defined by a first arc having a center point in the range of 300-400 mm from the bottom of the exercise device;

wherein the second rounded end is defined by a second arc having a center point in the range of 270-370 mm from the bottom of the exercise device; and wherein the first radius is defined by a distance between the first center point and a point on the first arc, and the second radius is defined by a distance between the second center point and a point on the second arc.

19. The exercise device of claim 1 wherein the height of the second rounded end is 70% to 80% of the height of the first rounded end wherein the heights are measured from the top of each of the first and second rounded ends to the ground directly below the respective top when the exercise device is at rest.

20. A method of exercising comprising providing an exercise device according to claim 1 and performing exercises using the exercise device for support and resistance.

* * * * *